US007427059B2

(12) United States Patent
Lyga et al.

(10) Patent No.: US 7,427,059 B2
(45) Date of Patent: Sep. 23, 2008

(54) PAPER HANDLING SYSTEM MATERIALS EXIT PATH ARRANGEMENT

(75) Inventors: Thomas M. Lyga, Southbury, CT (US); Carl R. Chapman, Monroe, CT (US)

(73) Assignee: Pitney Bowes Inc., Stamford, CT (US)

( * ) Notice: Subject to any disclaimer, the term of this patent is extended or adjusted under 35 U.S.C. 154(b) by 547 days.

(21) Appl. No.: 11/084,396

(22) Filed: Mar. 18, 2005

(65) Prior Publication Data

US 2006/0220307 A1 Oct. 5, 2006

(51) Int. Cl.
*B43M 3/00* (2006.01)

(52) U.S. Cl. ..... 270/58.06; 270/45; 270/51; 270/58.01; 270/58.18; 270/58.23; 270/52.19; 270/52.2; 270/52.22; 270/58.14; 270/58.29; 53/284.3; 53/569; 156/441.5

(58) Field of Classification Search ..... 270/45, 270/51, 52.04, 58.01, 58.06, 58.18, 58.23, 270/52.14, 52.19, 52.2, 52.22, 58.14, 58.29; 53/284.3, 569; 156/441.5
See application file for complete search history.

(56) References Cited

U.S. PATENT DOCUMENTS

| | | | | | |
|---|---|---|---|---|---|
| 5,054,757 | A * | 10/1991 | Martin et al. | ..... | 270/45 |
| 5,785,638 | A * | 7/1998 | Bristo et al. | ..... | 493/420 |
| 6,016,638 | A * | 1/2000 | Bernard et al. | ..... | 53/117 |
| 6,640,521 | B2 * | 11/2003 | Simkins et al. | ..... | 53/460 |
| 6,741,971 | B1 * | 5/2004 | Duval et al. | ..... | 705/401 |

* cited by examiner

*Primary Examiner*—Gene O. Crawford
*Assistant Examiner*—Leslie Nicholson, III
(74) *Attorney, Agent, or Firm*—Steven J. Shapiro; Angelo N. Chaclas

(57) ABSTRACT

A materials handling system includes an insertion subsystem for inserting materials into envelopes to form mailpieces of a first type and mailpieces of a second type. The materials handling syatem also includes a first mailpiece transport path located downstream from the insertion subsystem and having a curved portion along which mailpieces of said first type are transported, and a second mailpiece transport path being substantially horizontal, located downstream from the insertion subsystem, and along which mailpieces of the second type are transported. Further, a diverter is included that diverts mailpieces of the first type to the first transport path and mailpieces of the second type to the second transport path.

16 Claims, 5 Drawing Sheets

PAPER HANDLING SYSTEM MATERIALS EXIT PATH ARRANGEMENT

RELATED APPLICATIONS

The following application includes common inventorship, and has common drawings, detailed description, filing date and assignee and relates to insertion systems: U.S. application Ser. No. 11/084,233, for PAPER HANDLING SYSTEM MATERIAL FEED PATH ARRANGEMENT, filed Mar. 18, 2005, in the names of Carl Chapman, James Fairweather and Thomas M. Lyga and assigned to Pitney Bowes Inc.

FIELD OF THE INVENTION

The present invention relates to materials handling systems, such as paper handling equipment, and more particularly to a folder and inserter system with plural exit path arrangement for various materials to be processed.

BACKGROUND OF THE INVENTION

Insertion equipment desirably is capable of reliably handling a large variety of materials that are to be processed. The materials may be sheets to be folded, pre-folded and unfolded inserts, return or enclosure envelopes, and the envelope into which the materials are to be inserted. These materials may be of different sizes, thickness and types such as glossy pamphlets, advertising brochures or very thin sheet materials. Additionally the envelopes into which the materials are to be inserted can have different shaped envelope flaps, envelope throat profiles and envelope flap glue lines. Because equipment of this type has to handle a range of materials the machine exit paths may present the materials in a less than optimum orientation or may limit the range of materials that can be handled. In certain instances the machine may be required to be stopped and reconfigured for specific materials to be processed. This is compounded when thick or unbendable materials such as flats types of envelopes containing brochures, annual reports, large multisheet billing, and the like or delicate materials such as flats containing photos, glossy pamphlets, and the like, are processed in the machine along with materials of a normal thickness such as letter size envelopes.

Reliably processing such a range of materials is difficult and has led to equipment being designed with separate dedicated, less than optimum exit transport paths for various categories of materials to be processed. Moreover, these transport paths may enlarge the size of the equipment by requiring extra length or width for the machine if reliable processing is to be achieved. Systems must often compromise between being capable of handling types of mailpieces such as thicker, stiffer or larger mailpieces, or employing alternate exit methods which can be expensive and do not exit the mailpiece in the most desirable orientation. Many systems will have only one exit path which will allow for processing one general type of mail such as generic letter size mail in the United States and in Europe.

SUMMARY OF THE INVENTION

It is an object of the present invention to provide materials handling equipment, such as a folder and/or inserter system or other paper handling equipment, with plural exit paths for various materials to be processed which facilitate effective utilization of the equipment.

It is a further object of the present invention to provide paper handing equipment with envelope exit path arrangement that optimizes the orientation of envelopes to facilitate further processing and provides versatility in processing a range of materials and envelopes.

The present invention allows paper handling equipment such as an inserter system to exit standard mailpieces out through the normal letter size envelope exit path. By having an alternate exit path which is straight, the system can conveniently discharge thick or unbendable mailpieces without having to stop the system. Since the majority of the mailpieces are in many application of normal letter size and thickness, the present invention provides an transport path arrangement that optimize the processing of these mailpieces through one transport path while enabling the transport of other type envelopes and materials such as flats in an alternative straight exit transport path. Normal mailpieces are transported in a manner such that they exit the system in an optimal orientation. Moreover, this is achieved without increasing the size of the equipment nor by compromising the optimum orientation of the mailpiece at various subsystems such at an insertion subsystem where inserts are moved into an envelope to form a mailpiece.

The present invention enables the processing of letter size and also flats size envelopes at an insertion subsystem with the address or window side of the envelope facing downward. Transport paths for both the flats and the normal size envelopes are provided. The transport path for letter size mailpieces is such that when the mailpiece exits the system, the orientation of the mailpiece is reversed from the orientation at the insertion subsystem. A straight transport path from the insertion subsystem to the flats envelope exit is also provided such that flats envelopes do not bend as the flats envelopes are transported to exit the system. Letter size envelopes exit the system with the addressee bearing surface of the envelope or mailpiece facing upward with the envelope flap in a leading orientation and also sealed flap, if so desired. This facilitates additional processing of the mailpiece which can often be best implemented in this position such as metering, address printing and stacking. This exit orientation is a reversal from the orientation of the envelope at the insertion subsystem where the addressee bearing surface of the mailpiece is facing downward and the envelope flap in a trailing orientation. Moreover, positioning one of the transport paths above the other minimizes the machine foot print and results in the mailpieces from both transports exiting the system in a common area. The common area exit enhances operator convenience. If desired, the arrangement provided by the present invention enables selective alternative processing of mixed sized mailpieces without interruption of the system. For example, the system can be operated to run a mixed mail stream of letter and flat size mailpieces.

A materials handling system embodying the present invention includes a materials processing subsystem with a first materials transport path having a curved portion along which materials are transported and a second straight materials transport path along which materials are transported. One of the first materials transport path and the second materials transport path is positioned above the other materials transport path. A diverter is connected between the processing subsystem and the first material transport path and the second material transport path. The diverter is operable to selectively divert materials at the materials processing subsystem to be transported by one of said first and said second transport paths.

In accordance with an embodiment of the present invention, an insertion subsystem inserts materials into envelopes to form mailpieces of a first type and mailpieces of a second type. A first mailpiece transport path having a curved portion for transporting mailpieces of the first type and a second mailpiece transport path having a straight transport path for transporting mailpieces of the second type are provided. A diverter is connected between the insertion subsystem and the first mailpiece transport path and the second mailpiece transport path. The diverter is operable to divert mailpiece of the first type to the first mailpiece transport path and to divert mailpieces of the second type to the second envelope transport path.

In a materials handling system of the type having an insertion subsystem, a first system exit and a second system exit, a method embodying the present invention includes inserting materials into envelopes at an insertion subsystem to form mailpieces of a first type and mailpieces of a second type. Mailpieces of said first type are diverted from the insertion subsystem onto a first mailpiece transport path having a curved portion. The first mailpiece transport path is connected to the first systems exit and transports mailpieces of said first type to the first systems exit. Mailpieces of the second type are diverted from the insertion subsystem onto a second straight mailpiece transport path connected to a second system exit. The second mail piece transport path transports mailpieces of the second type to the second systems exit.

In accordance with a feature of the present invention, an addressee bearing side of mailpieces of the first type are oriented in a first direction at the insertion subsystem and the orientation of the mailpieces of the first type is changed as the mailpieces of the first type are transported to the first system exit such that said addressee bearing side of said mailpiece of said first type are oriented in a second direction.

In accordance with yet another feature of the present invention, the mailpieces of the first type include a flap connected to the mailpiece body which is oriented at the insertion subsystem with the flap trailing the mailpiece body. The orientation of the mailpiece flap is changed as mailpieces of the first type are transported to the first system exit such that the flap of the mailpiece is oriented with the flap leading.

BRIEF DESCRIPTION OF THE DRAWINGS

Reference is now made to the various figures wherein like reference numerals designate similar items in the various views and in which.

DETAILED DESCRIPTION OF THE PREFERRED EMBODIMENT

Figure 1:
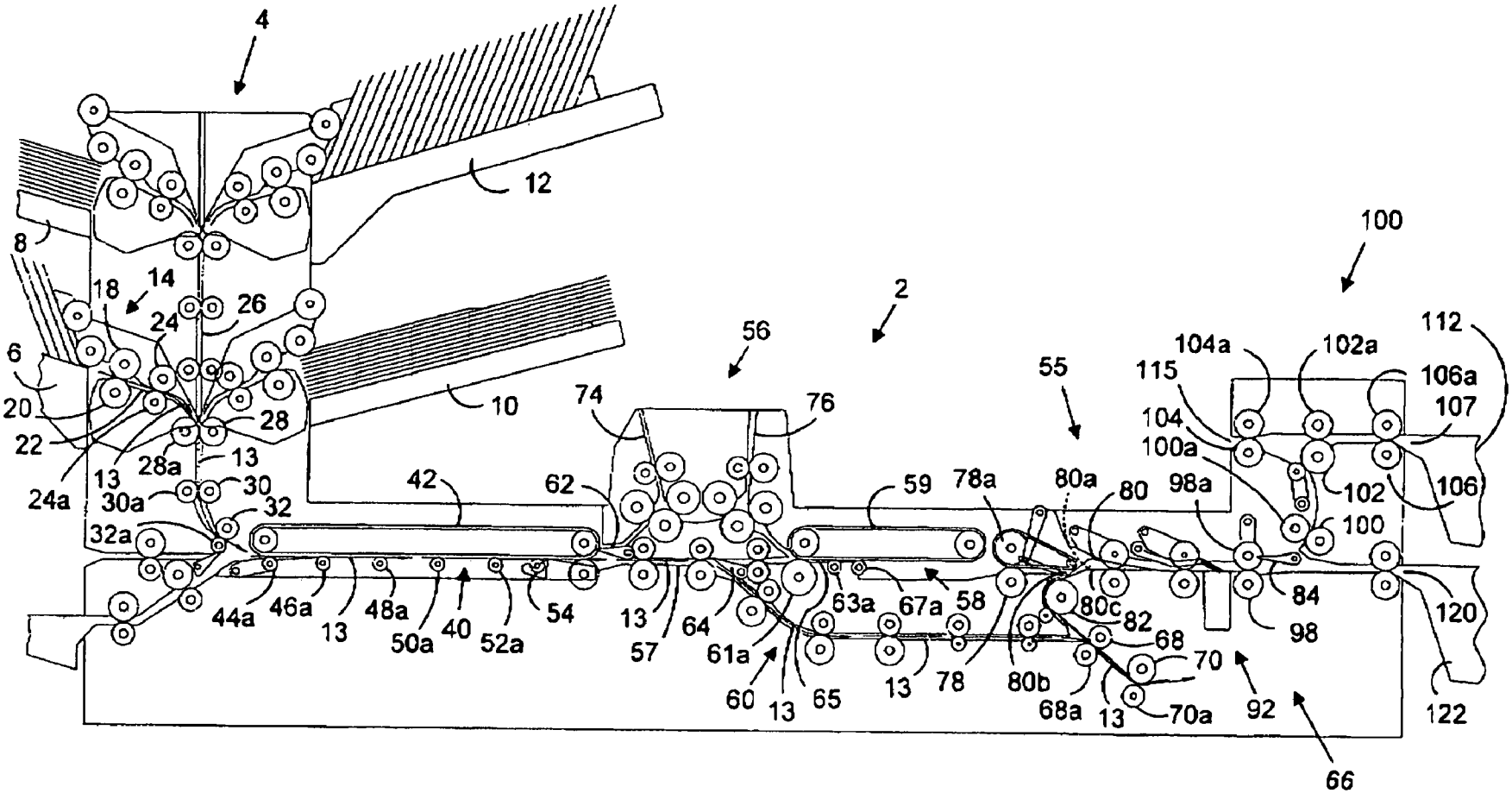
FIG. 1 is a diagrammatic view of a folder inserter system with plural exit path arrangement for various materials to be processed embodying the present invention and illustrating the envelope transport path from a detachable shingled envelope feed tray to the insertion subsystem.

Reference is now made to the various figures and more particularly to FIG. 1. A folder inserter system 2 includes vertical tower feed station 4 with a common material feed area. The tower feed station 4 provides a common feed area having detachable feed trays and associated feed mechanisms. The feed station 4 includes four separate detachable feed trays 6, 8, 10 and 12 for envelopes, sheets and inserts. Detachable feed tray 6 is a shingle envelope feed tray. Detachable feed tray 8 is a stacks sheet feed tray. Detachable feed tray 10 is a stacks sheet feed tray. Detach able feed tray 12 is a shingle insert feed tray. Various numbers and types of detachable feed trays and associated feeder mechanism can be included in the vertical tower feed station 4. The envelope transport path is depicted by the line 13 with arrowheads from detachable shingle envelope feed tray 4 through various subsystems to the insertion subsystem.

Figure 2:
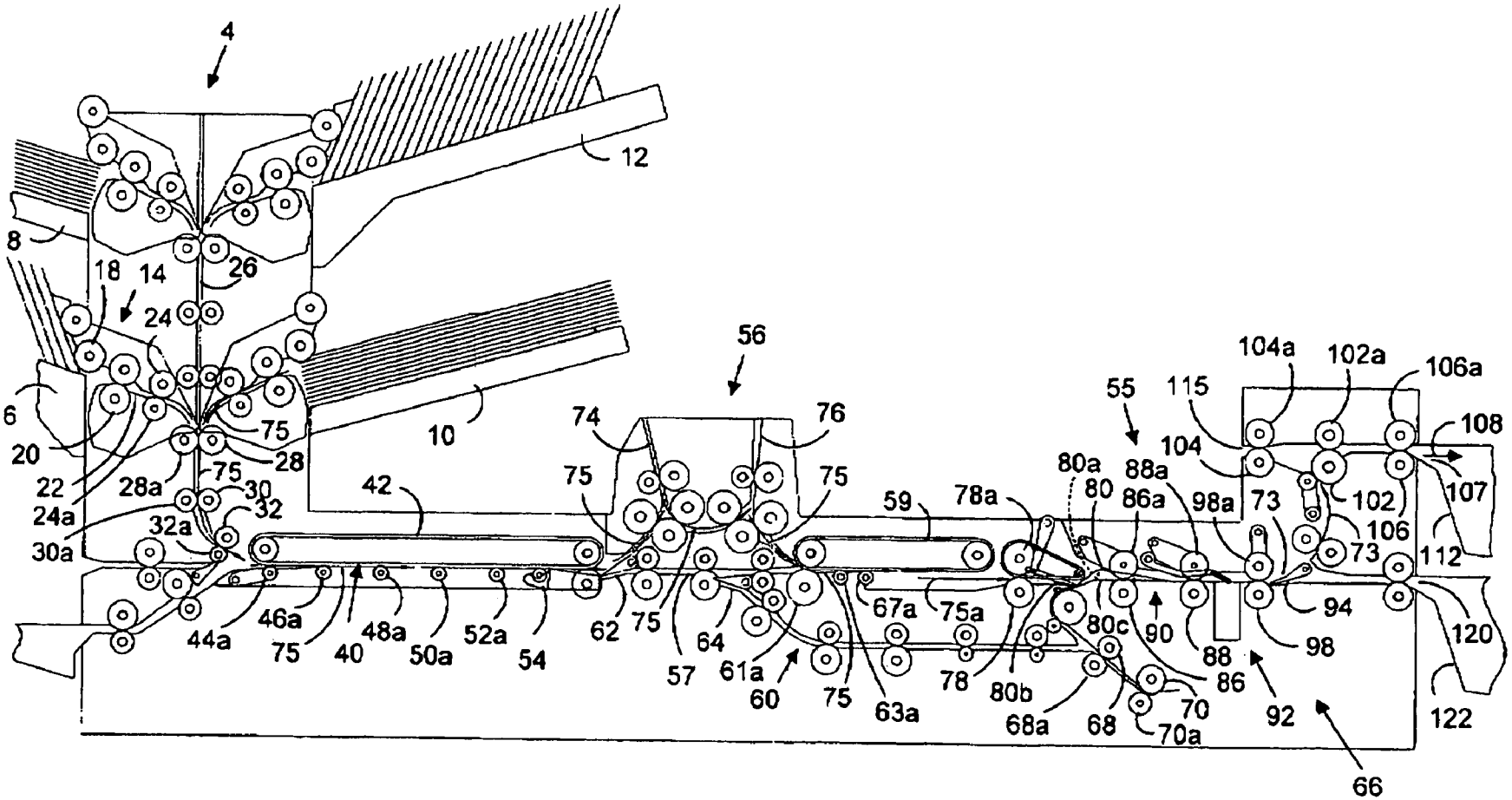
FIG. 2 is a diagrammatic view of the system shown in FIG. 1, illustrating the transport path for material to be folded by folder subsystem from a detachable stack feed tray, through the folder subsystem to the insertion subsystem and the transport path for an envelope from the insertion subsystem through the envelope flap sealer subsystem and through the letter exit to the letter stacker.
Figure 3:
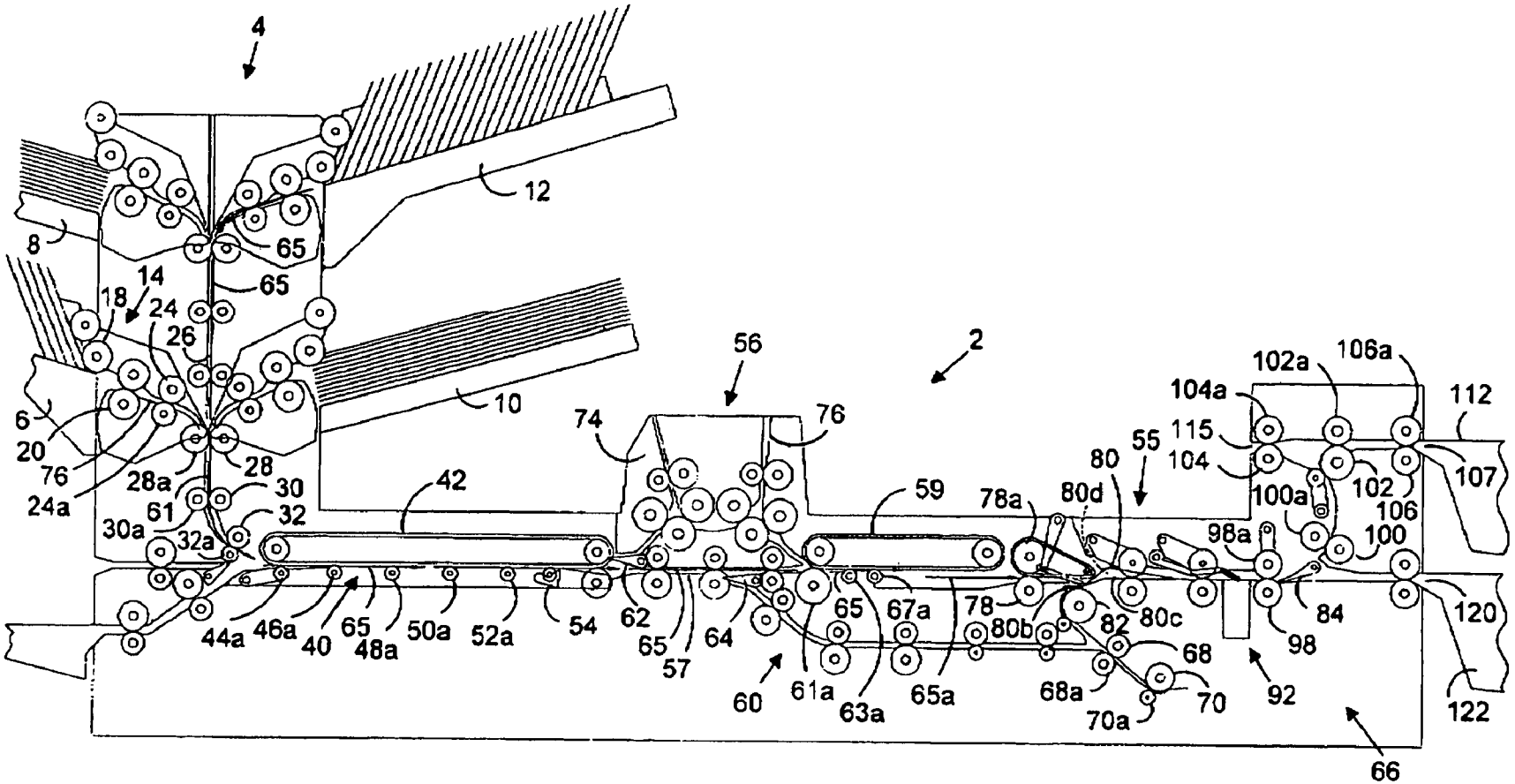
FIG. 3 is a diagrammatic view of the system shown in FIG. 1, illustrating the transport path for material that will not be folded by the folder subsystem from a detachable shingle material feed tray to the insertion subsystem.

Although the detachable feed trays show in FIGS. 1-3 are shown as having envelopes, sheets and inserts, each of these feed trays can feed other types of materials, which can be loaded (depending on the feed tray type) in a stacks or shingle orientation depending on the material involved. Thus, many types of material can be fed by any feed station mechanism. The materials can be, for example, pamphlets, brochures, return envelopes, cards, booklets, slips and checks. Moreover, permanent feed trays or bins of material to be processed can be part of the machine itself rather than detachable feed trays. Also, while identical feed mechanisms are shown for each of the four feeders 6, 8, 10 and 12 specifically designed feeders dedicated to processing particular materials can also be made part of the vertical tower feed station 4 if required for any particular application.

Each of the four feeder mechanisms such as feeder 14, includes a feed head mechanism in the vertical tower and an associated detachable feed tray such as detachable feed tray 6. The mechanisms in the vertical tower for each of the feeders are identical in structure, as previously noted; however, this does not need to be the case. When requirements dictate, the feeder and detachable or fixed materials feed tray or bin can be designed to accommodate specific materials and applications. The material (envelopes) in the detachable feed tray 6 are fed from the tray by the singulator arrangement including a drive roller 18 and retard roller 20. The material is fed from the tray, as depicted by line 13, along the feed head exit guide 22 by take away rollers 24 and associated idler roller 24*a* to a vertical common feed path 26 by the tower drive rollers 28, 30, and 32, with their associated idler rollers respectively 28*a*, 30*a*, and 32*a*.

As the material exits the vertical tower transport path 26, it is moved onto the pre-fold accumulator drive belt arrangement shown generally at 40. The material is driven by the drive belt 42, which operates in conjunction with a series of idler rollers 44*a*, 46*a*, 48*a*, 50*a* and 52*a* to move the material toward the pre-fold accumulator gate 54. The pre-fold accumulator gate 54 is selectively activated to accumulate material when in the blocking position. When in the non-blocking position as shown in FIG. 1, the pre-fold accumulator gate 54 allows accumulated material or non accumulated materials, as the case may be, to pass by the pre-fold accumulator gate 54 to other subsystems in the machine. The material, after passing the pre-fold accumulator gate 54 (when it is in its non-blocking position), will be transported through one of three transport paths to the insertion subsystem 55: the folding subsystem shown generally at 56; the folder bypass path 57 and the post accumulator transport path 58; or the folder bypass path 57 and the envelope transport path 60. The path of travel of the materials depends on the position of the fold/no fold bypass gate 62 and the envelope bypass gate 64.

Fold/no fold bypass gate 62 is selectively activated to divert material from the pre-fold accumulator drive arrangement 40 into the folder subsystem 56 and thereafter to the post accumulator transport path 58 or to bypass the folder subsystem 56. When the fold/no fold bypass gate 62 is positioned to bypass the folder subsystem 56, material from the pre-fold accumulator drive arrangement 40 may be transported onto the post fold accumulator transport path as shown in FIG. 3 or onto the envelope transport path as shown in FIG. 1. The transport path as shown in FIG. 3 from detachable shingle feed tray 12 to the insertion subsystem 55 depicted by the line 65 with arrowheads with the envelope bypass gate 64 is positioned so as not to divert materials being transported into the envelope transport path 60. For the transport path 13 shown in FIG. 1, the envelope bypass gate 64 is positioned so as to divert materials being transported into the envelope transport path 60.

Where the envelope bypass gate 64 is selectively positioned to divert materials (envelopes) to move from the pre-fold accumulator transport arrangement 40 to the envelope transport path 60, the envelope follows the path of travel as depicted by the line 13 through the envelope flap flapper subsystem 66. In the flapper subsystem 66 the envelope flap is opened by the action of controlled drive roller 68 and idler roller 68*a* along with flapper roller 70 and flapper idler roller 70*a*. The drive roller 68 is controlled to stop and reverse direction of rotation so as to transport the envelope with its flap open and trailing the body of the envelope. The envelope is transported toward the insertion subsystem 55 as depicted by line 13.

Figure 4:
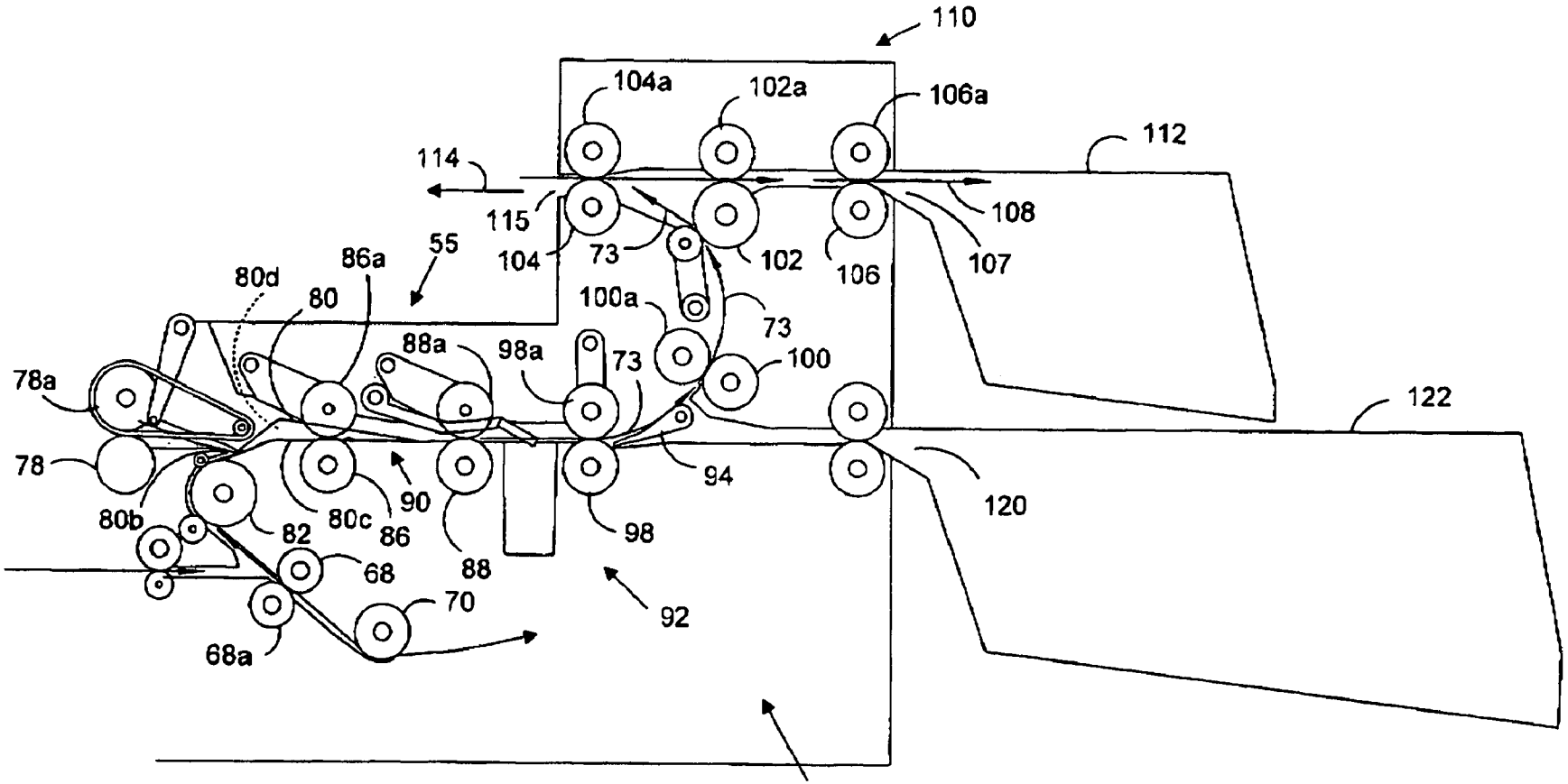
FIG. 4 is an enlarged diagrammatic view of the envelope flapper subsystem, insertion subsystem, moistener subsystem, sealer subsystem and exit portions of the system shown in FIG. 2, illustrating the transport path for letter size envelopes including the path to the letter envelope exit and to the letter stacker; and, FIG. 5 is an enlarged diagrammatic view of the envelope flapper subsystem, insertion subsystem, moistener subsystem, sealer subsystem and exit portions of the system shown in FIG. 1, illustrating the transport path for flats type materials from the insertion subsystem to the flats exit and to the flats stacker.
Figure 5:
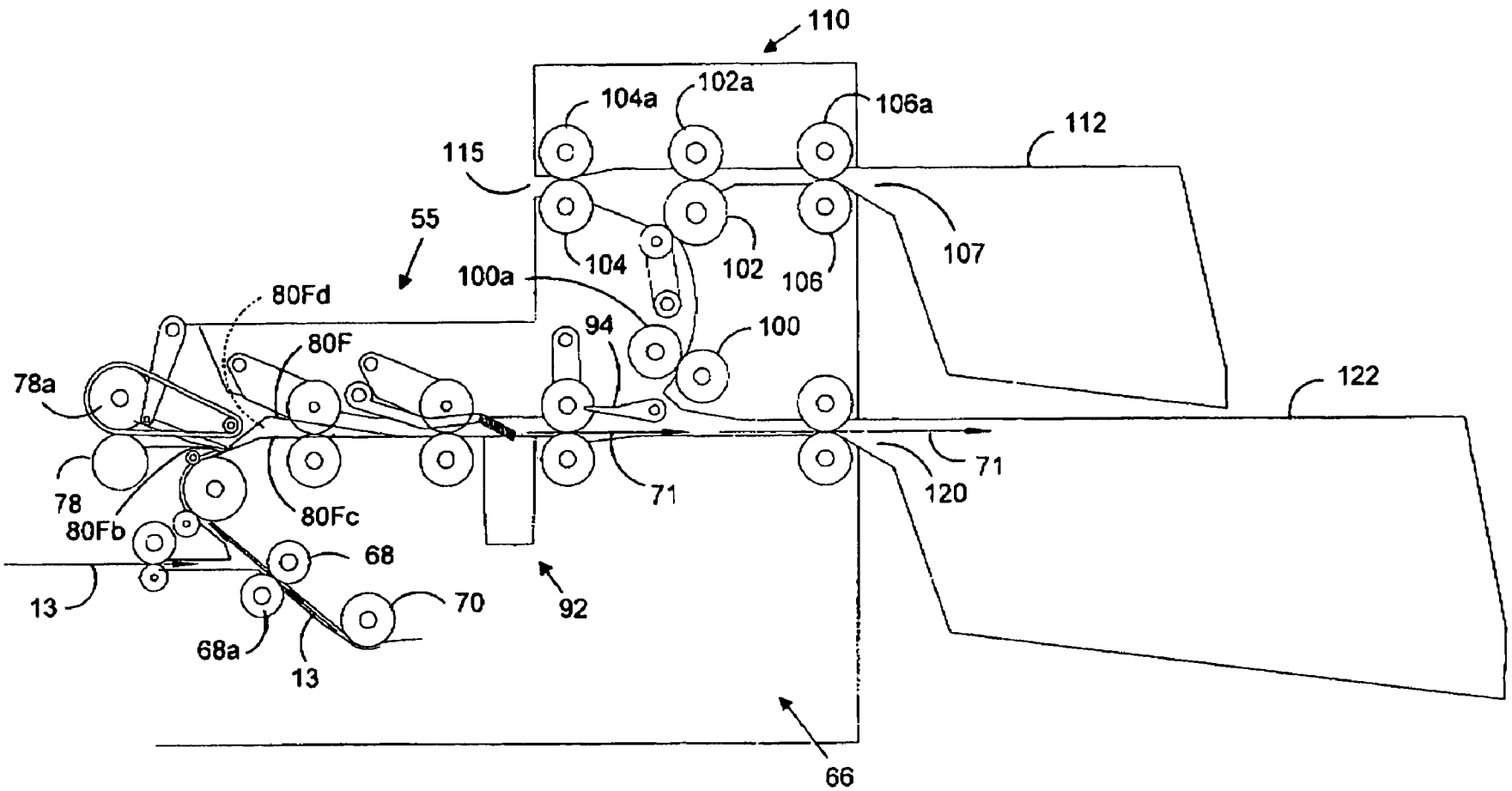

As is more clearly shown in FIG. 5, from the insertion subsystem 55, oversized envelopes with their materials, or stiff letter size envelopes or other materials, depending on the particular application, are moved along the flats envelope transport path depicted by line 71 with arrowheads to exit the machine. Letter-size envelopes, as shown in FIG. 4, are transported along the curved letter size envelope transport path depicted by line 73 with arrowheads to exit the machine. Over size materials are often referred to as flats. In the United States, mail pieces are considered to be flats when the mail piece exceeds at least one of the dimensional regulations of letter-sized mail (e.g. over 11.5 inches long, over 6 inches tall, or over ¼ inch thick) but does not exceed 15 inches by 11.5 by ¾ inch thick. Flats include such mail as pamphlets, annual reports and the like. It should be recognized that what constitutes letter sized mail pieces and oversized mail pieces varies from country to country. Moreover, the dimensions of the folder inserter system 2, such as the dimensions of the various transport paths and machine exits, can be designed to accommodate different sized items. Thus, "letter size" and "flats" terminology are used for convenience are not required sizes for the system to operate properly. The system 2 is capable of processing ranges of materials of differing size in the different transport paths.

Line 75 with arrowheads in FIG. 2 depicts the transport path for material to be folded by the system from the detachable stacks feed tray 10 to the insertion subsystem 55. Material to be folded are shown as being moved from the detachable stack feed tray 10 in the direction of line 75 transported along the vertical tower common feed path 26, the pre-fold accumulator transport arrangement 40 and, whether or not accumulated into multiple materials such as sheets, past the fold/no fold bypass gate 62 into the folder subsystem 56. In folder subsystem 56 the material is folded in folders 74 and 76 by controlled rollers or by other conventional means such as buckle chutes. It should be recognized that other materials processing subsystems can be employed with or replace the folder subsystem 56. Examples of such other subsystems are printing subsystems, paper perforation subsystems, stapling subsystems, hole punch subsystems and the like.

Materials are selectively moved from the various feeders onto the common transport path 26 and onto the pre-fold accumulator drive belt transport 42. Depending on the particular materials and process to be implemented, three separate transport paths are provided to the insertion subsystem 55. The materials may be selectively transported into the folder subsystem 56 or directed for ongoing transport depending on the position of the fold/no fold bypass gate 62. Materials directed for ongoing transport will either: travel along the folder bypass path 57 and the post accumulator transport as shown in FIG. 3 (portion of line 65 to the right of envelope bypass gate 64); or, as shown in FIG. 1 along the folder bypass path 57 and the envelope transport path 60 (portion of line 13 to the right of envelope bypass gate 64). The path of travel for this material directed for ongoing transport depends on the position of the envelope bypass gate 64. Thus all materials are transported along a common transport path and then selectively directed onto one of three different transport paths as they are moved to the insertion subsystem 55. This transport arrangement from a common feed area to the insertion subsystem provides enhanced flexibility of operation of the system and facilitates the utilization of a common feed area.

The material exits the folder subsystem 56 and is transported along the post-fold accumulator transport 58 by the post fold accumulator transport belt 59 and its associated rollers idler 61*a*, 63*a* and 67*a* to the insertion subsystem 55. The material traveling along the transport path depicted by line 75 (FIG. 2), or as the case may be, line 65 (FIG. 3), is controlled to accumulate as illustrated by the portion 75*a* of line 75 and 65*a* of line 65, as the case may be. This is achieved by stopping the rotation of controllable drive rollers 78 and thus stopping the movement of the materials through the nip of controllable drive rollers 78 and idler roller 78*a* when desired to accumulate material. The material or accumulated material is driven into the envelope 80, shown at the insertion subsystem 55 with the envelope flap 80*b* positioned around the envelope positioning roller 82 and the body of the envelope 80*c* having the address or window side of the envelope facing downward. The throat of the envelope 80*d* is extended by mechanical fingers, not shown, to enable insertion of the material into the envelope 80.

After the material is inserted into the envelope 80 as shown in FIGS. 2 and 4, the envelope exit drive rollers 86 and 88, in conjunction with idler rollers 86*a* and 88*a*, drive the envelope along the insertion deck 90 past an envelope flap glue line moistener subsystem shown generally at 92. A flats bypass gate 94 is shown positioned to cause an envelope, when driven along the insertion deck 90, to move along the curved envelope letter size transport path as depicted by line 73. The moistener subsystem 92 can be any of a variety of standard moistening arrangements to moisten the envelope flap glue line for sealing to the body of the envelope. As an envelope is driven into and along the curved letter transport path, the envelope is driven by a series of drive rollers 98, 100, 102, 104 and 106 and associated idler rollers 98*a*, 100*a*, 102*a*, 104*a* and 106*a*.

When an envelope body 80*c* is captured between drive roller 104 and its corresponding idler roller 104*a*, at a particular point, depending upon the size of the envelope, driver roller 104 will stop and reverse direction of rotation. The direction of rotation is reversed to drive the envelope to exit the machine along the letter size exit transport path as depicted by line 108 with arrowheads. The envelope flap 80*b* is caused to move against the body of the envelope 80*c* and is sealed in the sealer subsystem 110 by the force of drive roller 106 and sealer idler roller 106*a*. In this manner, a letter size envelope is transported from the insertion subsystem 55 along the curved letter size transport path into the sealer subsystem 110 and then along the letter size envelope exit transport path 108. The envelope body 80*c* exits the machine exit 107 into the letter stacker 112 the along the exit transport path 108. The envelope exits the machine with the address or window side of the envelope facing upward. This is a reversal of the orientation of the body of the envelope 80*c* from the envelope body orientation at the insertion subsystem 55. This change in orientation to exit the machine with the address or window side of the envelope body facing upward, facilitates further processing of the envelope, such as by a mailing machine or other device, stacker, printer, scanner and the like. If the envelope or other material is to be rejected for some reason, the envelope drive roller 104 would not change direction and the material would be caused to exit the machine along reject transport path 114, through the reject exit 115 to a reject bin, not shown.

Line 71 with arrowheads depicts an envelope path of travel for a flats type envelope 80F from the insertion subsystem 55 being transported along insertion deck 90 past the moistener subsystem 92 and being directed by the flats bypass gate 94 through the flats exit 120 and into the flats stacker 122. The flats envelope 80F is transported from a suitable detachable feed tray to the insertion subsystem 55 along the transport path depicted by line 13. The designations 80Fb, 80Fc and 80Fd correspond to letter size envelope 80 part designations Without inserts, the flats envelope 80F is sufficiently flexible to accommodate the curved portions of the transport path 13. The exit transport path depicted by line 71 may be employed for various materials depending on the application. For example, a stiff letter size envelope that is not sufficiently flexible with the inserts to be transported along the curved letter size transport may be directed along exit transport path 71. As can be seen, the flats bypass gate 94 is positioned in FIG. 5 to cause the flats material to be driven along the flats exit transport path 71 to exit the flats exit 120 into the flats stacker 122. It should be noted that in this embodiment, the flats envelope flap is not sealed. A sealer can be added at the flats path exit 120 or at another suitable point in the machine to operate independently or in conjunction with moistener subsystem 92, depending upon the particular design of the system.

From the insertion subsystem 55, three transport paths and three separate exit paths are provided and utilized depending on the nature of the material and the process to be achieved. The material can, as is shown in FIG. 5, move alone the insertion deck 90, the flats transport path 71 and through flats exit 120 into stacker 122. This is a straight transport path. The material can as is shown in FIG. 4, pass along the insertion deck 90, along curved letter size transport path 73, exit transport path 108 and through letter exit 107 into stacker 112. The material can, as is shown in FIG. 4, pass along the insertion deck 90, along curved letter size transport path 73, reject transport path 114 and through reject exit 115 into a reject bin not shown. This combination of transport exit paths provides enhanced flexibility of the operation of the system.

It should be recognized while specific belt and drive roller transport arrangements are shown in FIGS. 1-5, other suitable transport arrangements can be employed. Moreover, the orientation, shape and arrangement of the various transport paths and diverters can be modified to accommodate different types of materials and applications. For, example, the curved letter size envelope transport path can be positioned below rather than above the flats envelope transport path, or the folding subsystem subsystem and associated transport path can be positioned below rather than above the insertion subsystem. Also, the various subsystems and diverters can be replaced by different conventional subsystems or by other materials processing subsystems. Thus, while the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A materials handling system, comprising:

an insertion subsystem for inserting materials into envelopes to form mailpieces of a first type and mailpieces of a second type;

a first mailpiece transport path located downstream from said insertion subsystem and having a curved portion along which mailpieces of said first type are transported;

a second mailpiece transport path being substantially horizontal, located downstream from said insertion subsystem, and along which mailpieces of said second type are transported; and, a diverter connected between said insertion subsystem and said first mailpiece transport path and said second mailpiece transport path, said diverter operable to divert mailpiece of said first type to said first mailpiece transport path and to divert mailpieces of said second type to said second mailpiece transport path.

2. A materials handling system as recited in claim 1, further comprising first means for transporting mailpieces of said first type along said first mailpiece transport path curved portion and second means for transporting mailpieces of said second type along said second mailpiece transport path.

3. A materials handling system as defined in claim 2 wherein mailpieces of said first type have sufficient flexibility to be transported along said curved portion of said first mailpiece transport path.

4. A materials handling system as defined in claim 3 wherein mailpieces of said second type transported along said second transport path do not have sufficient flexibility to be transported along said curved portion of said first mailpiece transport path.

5. A materials handling system as defined in claim 2 wherein said first mailpiece transport path is located above said second mailpiece transport path.

6. A materials handling system as defined in claim 2 wherein said mailpieces of said first type are letter size mailpieces and said mailpieces of said second type are flats size mailpieces.

7. A materials handling system as defined in claim 2 wherein said mailpieces of said first type have an addressee bearing side facing in a first direction at said insertion subsystem and wherein said first mailpiece transport curved portion is such that the said addressee bearing side of said mailpiece is repositioned to face in a second direction as said mailpieces of said first type are transported along said first mailpiece transport curved portion.

8. A materials handling system as defined in claim 7 wherein said first direction is a downward and said second direction is an upward.

9. A materials handling system as defined in claim 1 further including a third mailpiece transport path connected to said first mailpiece transport path.

10. A materials handling system as defined in claim 9 further including a stacker and wherein said third mailpiece transport path is connected between said first mailpiece transport path and said sacker to permit transport of mailpieces of said first type from said first mailpiece transport path to said stacker.

11. A materials handling system as defined in claim 10 further including a second stacker for mailpieces of said second type and wherein said second mailpiece transport path is connected to said second stacker such that mailpieces of said second type are transported along said second mailpiece transport path from said diverter to said second stacker.

12. A materials handling system as recited in claim 10, further comprising means for transporting mailpieces of said first type along said third transport path.

13. A materials handling system as defined in claim 12 further including a moistener subsystem connected between said diverter and said first mailpiece transport path and a sealer subsystem located along said third mailpiece transport path.

14. A materials handling system as defined in claim 13 further including a fourth mailpiece transport path and means for causing mailpieces of said first type to be selectively directed for transport along either of said third and said fourth mailpiece transport paths.

15. A materials handling system as recited in claim 14, further comprising means for transporting mailpieces of said first type along said fourth transport path.

16. A materials handling system as defined in claim 15 wherein said mailpieces of said first type include rejected mailpieces that are transported along said fourth mailpiece transport path.

* * * * *